US005681677A

United States Patent [19]

Bugner et al.

[11] Patent Number: 5,681,677

[45] Date of Patent: Oct. 28, 1997

[54] PHOTOCONDUCTIVE ELEMENT HAVING A BARRIER LAYER

[75] Inventors: Douglas E. Bugner; Paul D. Vandervalk; Marie B. O'Regan, all of Rochester, N.Y.; Hal E. Wright, Johns Island, S.C.

[73] Assignee: Eastman Kodak Company, Rochester, N.Y.

[21] Appl. No.: 598,597

[22] Filed: Feb. 12, 1996

[51] Int. Cl.[6] ..... G03G 5/14

[52] U.S. Cl. ..... 430/58; 430/64

[58] Field of Search ..... 430/64, 65, 58

[56] References Cited

U.S. PATENT DOCUMENTS

| | | | |
|---|---|---|---|
| 3,007,901 | 11/1961 | Minsk | 260/78.3 |
| 3,018,272 | 1/1962 | Griffing et al. | 260/75 |
| 3,245,833 | 4/1966 | Trevoy | 117/201 |
| 3,262,807 | 7/1966 | Sterman et al. | 117/34 |
| 3,563,942 | 2/1971 | Heiberger | 260/29.2 |
| 3,734,874 | 5/1973 | Kibler et al. | 260/29.2 |
| 3,779,993 | 12/1973 | Kibler et al. | 260/755 |
| 3,880,657 | 4/1975 | Rasch | 96/15 |
| 3,929,489 | 12/1975 | Arcesi et al. | 96/115 |
| 4,082,551 | 4/1978 | Steklenski et al. | 96/1 PC |
| 4,175,960 | 11/1979 | Berwick et al. | 430/58 |
| 4,202,785 | 5/1980 | Merrill et al. | 430/106 |
| 4,307,174 | 12/1981 | Noonan et al. | 430/215 |
| 4,471,039 | 9/1984 | Borsenberger et al. | 430/58 |
| 4,758,492 | 7/1988 | Nair . | |
| 4,903,039 | 2/1990 | Light | 346/1.1 |
| 4,903,040 | 2/1990 | Light | 346/1.1 |
| 4,903,041 | 2/1990 | Light | 346/1.1 |
| 5,128,226 | 7/1992 | Hung | 430/58 |
| 5,138,024 | 8/1992 | Brozek et al. | 528/272 |
| 5,508,135 | 4/1996 | Lelental et al. | 430/63 |

OTHER PUBLICATIONS

Eastman Chemical Publication GN-389B, May 1990, pp. 2-3, 10-15.

*Primary Examiner*—John Goodrow
*Attorney, Agent, or Firm*—Doreen M. Wells

[57] ABSTRACT

The photoconductive element of the invention comprises an electrically conductive support and a photoconductive material capable of generating positive charge carriers when exposed to actinic radiation, the element having, situated between the support and the photoconductive material, an electrical barrier layer that restrains the injection of positive charge carriers from the conductive support, the barrier layer comprising a polyester ionomer. The method of the invention comprises coating on an electrically conductive support an aqueous dispersion of a polyester ionomer as a barrier layer, coating a charge generation layer over the barrier layer, and coating a p-type charge transport layer over the charge generation layer.

26 Claims, 1 Drawing Sheet

PHOTOCONDUCTIVE ELEMENT HAVING A BARRIER LAYER

CROSS REFERENCE TO RELATED APPLICATION

Reference is made to and priority claimed from U.S. Provisional application Ser. No. 60/003,092, filed 31 Aug. 1995, entitled PHOTOCONDUCTIVE ELEMENT HAVING A BARRIER LAYER.

FIELD OF THE INVENTION

This invention relates to electrophotography. More particularly, it relates to a novel photoconductive element that contains an electrical charge barrier layer. In addition, it relates to a method of making the novel photoconductive element.

BACKGROUND OF THE INVENTION

Photoconductive elements useful, for example, in electrophotographic copiers and printers are composed of a conducting support having a photoconductive layer that is insulating in the dark but becomes conductive upon exposure to actinic radiation. To form images, the surface of the element is electrostatically and uniformly charged in the dark and then exposed to a pattern of actinic radiation. In areas where the photoconductive layer is irradiated, mobile charge carriers are generated which migrate to the surface and dissipate the surface charge. This leaves in nonirradiated areas a charge pattern known as a latent electrostatic image. The latent image can be developed, either on the surface on which it is formed or on another surface to which it is transferred, by application of a liquid or dry developer containing finely divided charged toner particles.

Photoconductive elements can comprise single or multiple active layers. Those with multiple active layers (also called multi-active elements) have at least one charge-generation layer and at least one n-type or p-type charge-transport layer. Under actinic radiation, the charge-generation layer generates mobile charge carriers and the charge-transport layer facilitates migration of the charge carriers to the surface of the element, where they dissipate the uniform electrostatic charge and form the latent electrostatic image.

Also useful in photoconductive elements are charge barrier layers, which are formed between the conductive layer and the charge generation layer to restrict undesired injection of charge carriers from the conductive layer. Various polymers are known for use in barrier layers of photoconductive elements. For example, the patent to Hung, U.S. Pat. No. 5,128,226, discloses a photoconductor element having an n-type charge transport layer and a barrier layer, the latter comprising a particular vinyl copolymer. Steklenski, et al., U.S. Pat. No. 4,082,551, refers to Trevoy, U.S. Pat. No. 3,428,451, as disclosing a two-layer system that includes cellulose nitrate as an electrical barrier.

The known barrier layer materials, however, have certain drawbacks, especially when used with elements having p-type charge transport layers. In particular, known barrier layer materials are not sufficiently resistant to the injection of positive charges (also known as "holes") from the conductive layer of the photoconductive element. In addition, certain polymers that have been suggested as barrier layer materials are difficult to coat as layers of a photoconductive element or require organic solvents. Accordingly, a need exists for a photoconductive element that can be negatively charged, contains a p-type photoconductor, and includes an electrical barrier layer that can be easily coated from an aqueous medium and has good resistance to the injection of positive charges. In accordance with the present invention, a novel photoconductive element that meets such a need is provided.

BRIEF SUMMARY OF THE INVENTION

The photoconductive element of the invention comprises an electrically conductive support and a photoconductive material capable of generating positive charge carriers when exposed to actinic radiation, the element having, situated between the support and the photoconductive material, an electrical barrier layer that restrains the injection of positive charge carriers from the conductive support, the barrier layer comprising a polyester ionomer.

In a preferred embodiment, the barrier layer is formed from an aqueous dispersion of a polyester ionomer coated over the conductive support.

The method of the invention comprises coming on an electrically conductive support an aqueous dispersion of a polyester ionomer as a barrier layer, coating a charge generation layer over the barrier layer, and coating a p-type charge transport layer over the charge generation layer.

THE DRAWINGS

The invention will be described in more detail by reference to the drawings, of which the sole figure is a schematic cross section, not to scale, of one embodiment of a photoconductive element of the invention.

DETAILED DESCRIPTION OF THE INVENTION

Figure 1:
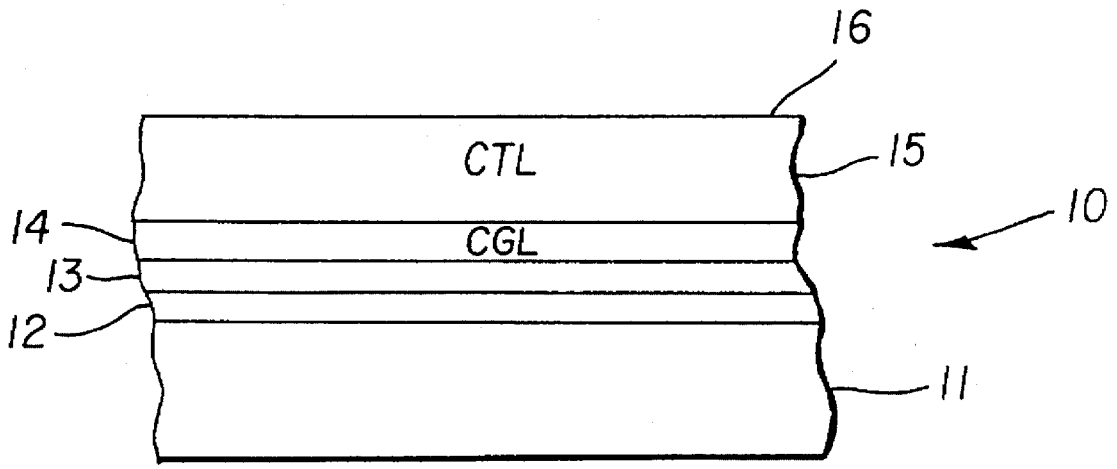

As illustrated in the drawing, a photoconductive element 10 of the invention comprises a polymeric film support 11. On this support is coated an electrically conductive layer 12. Over the conductive layer is coated a barrier layer 13 comprising a polyester ionomer; the barrier layer restricts the injection of positive charges (holes) from the conductive layer. Over the barrier layer is coated a charge generation layer 14, and over the latter is coated a p-type charge transport layer 15, which is capable of transporting positive charge carriers generated by layer 14 to dissipate negative charges on the surface 16 of the photoconductive element 10.

The charge-generation and charge-transport layers of the photoconductive element are coated on an "electrically-conductive support", by which is meant either a support material that is electrically-conductive itself or a support material comprising a non-conductive substrate, such as support 11 of the drawing, on which is coated a conductive layer 12, such as vacuum deposited nickel. The support can be fabricated in any suitable configuration, for example, as a sheet, a drum, or an endless belt.

Examples of "electrically-conductive supports" include paper (at a relative humidity above 20 percent); aluminum-paper laminates; metal foils such as aluminum foil, zinc foil, etc.; metal plates or drums, such as aluminum, copper, zinc, brass, and galvanized plates or drums; vapor deposited metal layers such as silver, chromium, nickel, aluminum, and the like coated on paper or on conventional photographic film bases such as cellulose acetate, poly(ethylene terephthalate) polystyrene, etc. Such conducting materials as chromium, nickel, etc., can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers, both with and without electrical barrier layers, are described in Trevoy, U.S. Pat. No. 3,245,833, issued Apr. 12, 1966. Other useful conducting layers include compositions consisting essentially of an intimate mixture of at least one inorganic oxide and from about 30 to about 70 percent by weight of at least one conducting metal, e.g., a vacuum-deposited cermet conducting layer as described in Rasch, U.S. Pat. No. 3,880,657, issued Apr. 29, 1975. Likewise, a suitable conducting coating can be prepared from the sodium salt of a carboxyester lactone of maleic anhydride and a vinyl acetate polymer. Such kinds of conducting layers and methods for their preparation and use are disclosed in Minsk, U.S. Pat. No. 3,007,901, issued Nov. 7, 1961 and Sterman et al., U.S. Pat. No. 3,262,807, issued Jul. 26, 1966. All said patents are incorporated herein by reference.

The term polyester ionomer refers to polyesters that contain ionic moieties in sufficient number to render the polymer water-dispersible. The polymer comprising the barrier layer of the photoconductive element of the invention, which restrains the injection of positive holes from the conducting support and thereby markedly reduces image or copy defects, can be defined broadly as a polyester ionomer. These polyesters are prepared by reacting one or more dicarboxylic acids or their functional equivalents such as anhydrides, diesters, or diacid halides with one or more diols in melt phase polycondensation techniques. The ionic moieties required for water-dispersibility may be included in the dicarboxylic acid or in the diol reactants, or in both. Procedures for the preparation of polyester ionomers are described in U.S. Pat. Nos. 3,018,272; 3,563,942; 3,734,874; 3,779,993; 3,929,489; 4,307,174, the disclosures of which are incorporated herein by reference.

The polyester ionomer employed in the barrier layer of the present invention comprises the polymeric reaction product of: a first dicarboxylic acid; a second dicarboxylic acid comprising an aromatic nucleus to which is attached an ionic sulfate group; and an aliphatic cycloaliphatic, or aralkyl diol compound, or mixtures thereof. The second dicarboxylic acid comprises from about 1 to 40 mol percent of the total moles of first and second dicarboxylic acids.

The first dicarboxylic acid or its anhydride, diester, or diacid halide functional equivalent may be represented by the formula:

$$-\overset{O}{\overset{\|}{C}}-R_1-\overset{O}{\overset{\|}{C}}-$$

where $R_1$ is an aromatic or aliphatic group or contains both aromatic and aliphatic groups. Examples of such acids include isophthalic acid, 5-t-butylisophthalic acid, 1,1,3-trimethyl-3-4-(4-carboxylphenyl)-5-indancarboxylic acid, terephthalic acid, 2,6-naphthalenedicarboxylic acid, or mixtures thereof. The first acid may also be an aliphatic diacid of the formula, HOOC—$(CH_2)_n$—COOH, where n=2 to 12, such as succinic acid, adipic acid, and others. The first dicarboxylic acid is preferably an aromatic acid or a functional equivalent thereof, most preferably, isophthalic acid.

The second dicarboxylic acid is a water-dispersible aromatic acid containing an ionic moiety that is a sulfonic acid group or its metal or ammonium salt. Examples include the sodium, lithium, potassium or ammonium salts of sulfoterephthalic acid, sulfonaphthalenedicarboxylic acid, sulfophthalic acid, sulfoisophthalic acid, and 5-(4-sulfophenoxy) isophthalic acid, or their functionally equivalent anhydrides, diesters, or diacid halides. Most preferably, the second dicarboxylic acid comprises a soluble salt of 5-sulfoisophthalic acid or dimethyl 5-sulfoisophthalate. The ionic dicarboxylic acid repeating units of the polyester ionomers employed as barrier layers in accordance with the invention comprise from about 1 to about 40 mol percent, preferably about 5 to 25 mole percent of the total moles of dicarboxylic acids.

Suitable diols are represented by the formula: HO—$R_2$—OH, where $R_2$ is aliphatic, cycloaliphatic, or aralkyl. Examples of useful diol compounds include the following: ethylene glycol, propylene glycol, 1,2-cyclohexanedimethanol, 1,2-propanediol, 4,4'-isopropylidene-bisphenoxydiethanol, 4,4'-indanylidene-bisphenoxydiethanol, 4,4'-fluorenylidene-bisphenoxydiethanol, 1,4-cyclohexanedimethanol, 2,2'-dimethyl-1,3-propanediol, p-xylylenediol, and glycols having the general structure H-$(OCH_2CH_2)_n$—OH, where n=2 to 10. Diethyleneglycol, 1,4-cyclohexanedimethanol, and mixtures thereof are especially preferred.

The polyester ionomers have a glass transition temperature ($T_g$) of about 60° C. or less and, preferably, from about 25° C. to 60° C. $T_g$ values can be determined by techniques such as differential scanning calorimetry or differential thermal analysis, as disclosed in N. F. Mott and E. A. Davis, *Electronic Processes in Non-Crystalline Material,* Oxford University Press, Belfast, 1971, p. 192. Preferred polyester ionomers for barrier layers in the photoconductive elements of the invention include the EASTMAN AQ® polymers manufactured by Eastman Chemical Company of Kingsport, Tenn. These polymers are relatively high molecular weight ($M_n$ about 14,000 to 16,000) amorphous polyesters that disperse directly in water without the assistance of organic cosolvents, surfactants, or amines. This water dispersibility is attributable in large part to the presence of ionic substituents, for example, sodiosulfo moieties ($SO_3^-Na^+$) in the polymer. Typically, a polymer molecule contains five to eight sodiosulfo substituents. Properties and uses of these polymers are described in Publication No. GN-389B of Eastman Chemical Company, dated May 1990, the disclosure of which is incorporated herein by reference. Especially preferred are poly[1,4-cyclohexylenedimethylene-co-2,2'-oxydiethylene (46/54) isophthalate-co-5-sodiosulfo-1,3-benzenedicarboxylate (82/18)] (obtained as EASTMAN AQ® 55 polymer, $T_g$ 55° C. from Eastman Chemical Co.); poly[1,4-cyclohexylenedimethylene-co-2,2'-oxydiethylene (22/78) isophthalate-co-5-sodiosulfo-1,3-benzenedicarboxylate (89/11)] (obtained as EASTMAN AQ® 38 polymer, $T_g$ 38° C., from Eastman Chemical Co.); and poly[2,2'-oxydiethylene isophthalate-co-5-sodiosulfo-1,3-benzenedicarboxylate (89/11)] (obtained as EASTMAN AQ® 29 polymer, $T_g$ 29° C., from Eastman Chemical Co.). In such preferred polymers, the molar ratios of the monomers can vary substantially and still provide good results. In general, such especially preferred polymers can be defined as poly[1,4-cyclohexylenedimethylene-co-2,2'-oxydiethylene (x/100-x) isophthalate-co-5-sodiosulfo-1,3-benzenedicarboxylate (100-y/y)], wherein x=0 to 70 mol percent and y=5 to 40 mol percent. Best results are achieved when the ratios are x=0 to 40 mol percent and y=5 to 25 mol percent.

Other particularly suitable polyester ionomers for barrier layers in the photoconductive elements of the present invention are disclosed in U.S. Pat. Nos. 4,903,039 and 4,903,040, which are incorporated herein by reference. Other polyesters that include malonate and iminobis-sulfonylbenzoate monomers are disclosed in U.S. Pat. No. 4,903,041, incorporated herein by reference.

The barrier layer composition can be applied by coating an aqueous dispersion of the polyester ionomer on the electrically conductive support using, for example, a technique such as knife coating, spray coating, swirl coating, extrusion hopper coating, or the like. After application to the conductive support, the coating can be air dried. An important advantage of the described polyester ionomer is that the ionic moieties make the polyers water-dispersible, allowing them to be coated as aqueous dispersions to form the barrier layer. It should be understood, however, that, if desired, the polyester ionomers can be coated as solutions or dispersions in organic solvents.

The photoconductive charge generating layer is applied over the barrier layer. The charge generating layer preferably comprises a photoconductor (or photoconductive agent) dispersed in a polymeric binder or a vacuum sublimed pigment, as disclosed in U.S. Pat. No. 4,471,039, or an aggregate layer as disclosed in U.S. Pat. No. 4,175,960, both of which patents are incorporated herein by reference. The layer can have a thickness which varies over a wide range, typical thicknesses being in the range of about 0.05 to about 6 microns. As those skilled in the art appreciate, as layer thickness increases, a greater proportion of incident radiation is absorbed by a layer, but the likelihood increases of trapping a charge carrier which then does not contribute to image formation. Thus, an optimum thickness of a given such layer can constitute a balance between these competing effects.

A wide variety of organic and inorganic materials can be employed in the charge generation layer. Inorganic materials include, for example, zinc oxide, lead oxide and selenium. Organic materials include various particulate organic pigment materials and a wide variety of soluble organic compounds, including metallo-organic and polymeric organic photoconductors. A partial listing of representative photoconductive materials may be found, for example, in Research Disclosure, Vol. 109, May 1973, page 61, in an article entitled "Electrophotographic Elements, Materials and Processes", at paragraph IV(A) thereof, the disclosure of which is incorporated herein by reference. Examples of suitable organic photoconductors for use in the charge generation layer include: phthalocyanine pigments, such as a bromoindium phthalocyanine pigment, described in U.S. Pat. No. 4,727,139, a titanylphthalocyanine pigment, described in U.S. Pat. No. 4,701,396; aggregates as described in U.S. Pat. No. 4,175,960; or a perylene compound as described in U.S. Pat. No. 4,719,163; such patents being incorporated herein by reference.

A wide variety of dyes or spectral sensitizing compounds can be used for example, various pyrylium salts such as pyrylium, bispyrylium, thiapyrylium, and selenapyrylium dye salts, as disclosed, for example, in U.S. Pat. No. 3,250,615; fluorenes, such as 7, 12-dioxo-13-dibenzo(a,h) fluorene and the like; aromatic nitro compounds of the kind disclosed in U.S. Pat. No. 2,610,120; anthrones such as those disclosed in the U.S. Pat. No. 2,670,284; quinones such as those disclosed in U.S. Pat. No. 2,670,286; benzophenones such as those disclosed in U.S. Pat No. 2,670,287; thiazoles, such as those disclosed in U.S. Pat. No. 3,732,301; the disclosures of these patents being incorporated herein by reference; also various other dyes such as cyanine (including carbocyanine and merocyanine), diarylmethane, thiazine, azine, oxazine, xanthene, phthalein, acridine, azo, anthraquinone dyes, and mixtures thereof.

The photoconductor, or mixture of photoconductors, is usually applied from a solution in a coating composition to form a charge generating layer in an element over a barrier layer of the type provided in this invention. Also typically present as dissolved solids in a photoconductor layer coating composition are a binder polymer and optional additives. In general, such compositions may be prepared by blending the components together in a solvent or a mixture of solvents.

As the binder polymer, various hydrophobic organic polymers can be used. These polymers preferably are soluble in an organic solvent and, in solid form, have dielectric strength and electrical insulating properties. Suitable polymers include, for example, styrene-butadiene copolymers; polyvinyl toluene-styrene copolymers; silicone resins; styrene alkyd resins; silicone-alkyd resins; soya-alkyd resins; poly(vinyl chloride); poly(vinylidene chloride); vinylidene chloride-acrylonitrile copolymers; poly(vinyl acetate); vinyl acetate-vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc.; polystyrene; nitrated polystyrene; polymethylstyrene; isobutylene polymers; polyesters, such as poly[ethylene-co-alkylene-bis (alkylene-oxyaryl)phenylenedicarboxylate]; phenolformaldehyde resins; ketone resins; polyamides; polycarbonates; poly[ethylene-co-isopropylidene-2,2-bis(ethylene-oxyphenylene)terephthalate]; co-polymers of vinyl haloarylates and vinyl acetate, such as poly(vinyl-m-bromobenzoate-co-vinyl acetate); chlorinated polyolefins such as chlorinated polyethylene; and the like. Preferred polymers are polycarbonates and polyesters.

One or more hole donor agents can also be added, such as 1,1-bis(4-di-p-tolylaminophenyl) cyclohexane, as taught in U.S. Pat. No. 4,127,412, incorporated herein by reference, tri-p-tolylamine, and the like. Coating aids, such as levelers, surfactants, crosslinking agents, colorants, plasticizers, and the like can also be added. The quantity of each of the respective additives present in a coating composition can vary, depending upon results desired and user preferences.

The photoconductive charge generating layer composition is applied by coating the composition over the barrier layer using a technique such as above described for coating a barrier layer composition. After coating, the charge generating layer composition can be air dried.

The charge transport layer can be comprised of any material, organic or inorganic, which is capable of transporting positive charge carriers generated in the charge generation layer. Most charge transport materials preferentially accept and transport either positive charges (holes) or negative charges (electrons), although there are materials known which will transport both positive and negative charges. Transport materials which exhibit a preference for conduction of positive charge carriers are referred to as p-type transport materials whereas those which exhibit a preference for the conduction of negative charges are referred to as n-type.

Various p-type organic charge transport materials can be used in the charge transport layer in accordance with the present invention. Any of a variety of organic photoconductive materials which are capable of transporting positive charge carriers may be employed. Representative p-type organic photoconductive materials include:

1. Carbazole materials including carbazole, N-ethylcarbazole, N-isopropyl carbazole, N-phenyl carbazole, halogenated carbazoles, various polymeric carbazole materials such as poly(vinyl carbazole), halogenated poly(vinyl carbazole), and the like.

2. Arylamine containing materials including monoarylamines, diarylamines, triarylamines, as well as polymeric arylamines. A partial listing of specific arylamine organic photoconductors include the non-polymeric triphenylamines illustrated in Klupfel et al., U.S. Pat. No. 3,180,730, issued Apr. 27, 1965; the polymeric triarylamines described in Fox, U.S. Pat. No. 3,240,597, issued Mar. 15, 1966; the triarylamines having at least one of the aryl radicals substituted having by either a vinyl radical or a vinylene radical having at least one active hydrogen-containing group, as described in Brantly et al., U.S. Pat. No. 3,567,450, issued Mar. 2, 1971; the triarylamines in which at least one of the aryl radicals is substituted by an active hydrogen-containing group, as described in Brantly et al., U.S. Pat. No. 3,658,520, issued Apr. 25, 1972; the disclosures of these patents being incorporated herein by reference; and tritolylamine. Especially preferred are 3,3'-(4-p-tolylaminophenyl)-1-phenylpropane, 1,1-bis(4-di-p-tolylaminophenyl) cyclohexane, and tritolylamine.

3. Polyarylalkane materials of the type described in Noe et al., U.S. Pat. No. 3,274,000, issued Sep. 20, 1966; Wilson, U.S. Pat. No. 3,542,547, issued Nov. 24, 1970; and in Rule et al. U.S. Pat. No. 3,615,402, issued Oct. 26, 1971; the disclosures of these patents being incorporated herein by reference. Preferred polyarylalkane photoconductors can be represented by the formula:

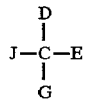

wherein:

D and G, which may be the same or different, represent aryl groups and J and E, which may be the same or different, represent a hydrogen atom, an alkyl group, or an aryl group, at least one of D, E and G containing an amino substituent. An especially useful polyarylalkane photoconductor which may be employed as the charge transport materials is a polyarylalkane having the formula noted above wherein J and E represent a hydrogen atom, an aryl group, or an alkyl group and D and G represent substituted aryl groups having as a substituent thereof a group represented by the formula:

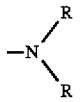

wherein:

R represents an unsubstituted aryl group such as phenyl or an alkyl substituted aryl such as a tolyl group. Especially preferred is 4,4'-bis(diethylamino) tetraphenylmethane. Additional information concerning certain of these latter polyarylalkanes may be found in Rule et al., U.S. Pat. No. 4,127,412 issued Nov. 28, 1978, incorporated herein by reference.

4. Strong Lewis base materials such as aromatic materials, including aromatically unsaturated heterocyclic materials which are free of strong electron withdrawing groups. A partial listing of such aromatic Lewis base materials includes tetraphenylpyrene, 1-methylpyrene, perylene, chrysene, anthracene, tetraphene, 2-phenylnaphthalene, azapyrene, fluorene, fluorenone, 1-ethylpyrene, acetylpyrene, 2,3-benzochrysene, 3,4-benzopyrene, 1,4-bromopyrene, phenylindole, polyvinyl carbazole, polyvinyl pyrene, polyvinyl tetracene, polyvinyl perylene, and polyvinyl tetraphene.

5. Other useful p-type charge-transport materials which may be employed in the present invention are any of the p-type organic photoconductors, including metalloorgano materials, known to be useful in electrophotographic processes, such as any of the organic photoconductive materials described in *Research Disclosure,* Vol. 109, May 1973, pages 61–67, paragraph IV(A)(2) through (13) which are p-type photoconductors.

Also useful for the practice of this invention are bipolar charge transport materials, which are capable of transporting either holes or electrons, for example, the stable free radicals disclosed in Bugnet et al., U.S. Pat. No. 5,374,604, column 5, line 17 through column 6, line 6, the disclosure of which is incorporated herein by reference.

The preferred embodiments of the present invention comprise multi-active photoconductive elements having separate charge generation layers and charge transport layers; such elements provide superior photographic speed and benefit the most from the use of a barrier layer to restrain migration of positive charge carriers from the conductive support. However, it should be understood that the invention also includes single layer photoconductive elements having a polyester ionomer barrier layer between the conductive support and the photoconductive layer. Even with such single layer elements, the injection of positive charges from the conductive support is a problem. Hence, the inclusion of a barrier layer in accordance with the invention provides a valuable improvement in such elements.

A serious problem solved or reduced by the novel photoconductive elements of the invention is the unwanted migration of positive charge carriers from the electrically conductive support through the photoconductive material. When such migration or charge injection occurs, surface charges on the photoconductive element are dissipated in non-exposed areas of the surface, i.e., in dark areas not exposed to actinic radiation. Consequently, when charged toner contacts the photoconductive surface, it causes unwanted development in background areas. In the case of an electrophotographic copying image wherein a negatively charged photoconductive element is contacted with positively charged toner particles, the breakdown or discharge in non-exposed areas will appear as white spots in the image. On the other hand, in a printer such as a high speed laser printer or LED primer, where a negatively charged photoconductive element is contacted with negatively charged toner, (so-called "discharged area development") the defect caused by positive charge injection from the electrically conductive support will show up as black spots in the background of the document. This is a somewhat more serious defect; consequently, the photoconductive element of the invention provides most significant advantages in the development of negatively charged photoconductors with negatively charged toner.

The following examples further illustrate the invention.

Example 1

A multi-active photoconductive film comprising a conductive support, a barrier layer (BL), a charge generation layer (CGL), and a charge transport layer (CTL), coated in that order, was prepared as follows:

A barrier layer solution comprising 3.5 wt % poly [1,4-cyclohexylene-dimethylene-co-2,2'-oxydiethylene (46/54) isophthalate-co-5-sodiosulfo-1,3-benzenedicarboxylate (82/18) (a water-dispersible polyester ionomer obtained from Eastman Chemicals Company as AQ®55S polymer) and 0.12 wt % Olin 10G coating surfactant in distilled water was coated at a dry coverage of 0.02 g/ft$^3$ on a conductive support which was a nickellized poly(ethylene terephthalate) film of 4-mil thickness.

Coated thereon at a dry coverage of 0.6 g/ft$^2$ was a CGL mixture comprising 49.5 wt % polycarbonate (Lexan™), 2.5 wt % poly(ethylene-co-2,2-dimethylpropylene terephthalate), 39.25 wt % 1,1-bis-[4-(di-4-tolylamino) phenyl]cyclohexane, 0.75 wt % diphenylbis-(4-diethylaminophenyl)methane, 6.4 wt % 4-(4-dimethylaminophenyl)-2,6-diphenylthiapyrylium hexafluorophosphate aggregating dye, 1.6 wt % 4-(4-dimethylaminophenyl)-2-(4-ethoxyphenyl)-6-phenylthiapyrylium fluoroborate aggregating dye, and 2.4 wt % of aggregate "seed" (a dried paste of the above CGL mixture which had been previously prepared). The CGL mixture was prepared at 8.5 wt % in a 70/30 (wt/wt) mixture of dichloromethane and 1,1,2-trichloroethane. DC510 coating surfactant was added at a concentration of 0.01 wt % of the total CGL mixture.

A third layer of a CTL was coated onto the CGL at a dry coverage of 1.25 g/ft$^2$. The CTL mixture comprised 60 wt % poly[4,4'-2-norbornylidene)bisphenylene terephthalate-co-azelate-(60/40)], 19.75 wt % 1,1-bis-[4-(di-4-tolyamino) phenyl]cyclohexane, 19.5 wt % tri-(4-tolyl)amine, and 0.75 wt % diphenylbis-(4-diethylaminophenyl)methane. The CTL mixture was prepared at 10 wt % in a 70/30 (wt/wt) mixture of dichloromethane and methyl acetate. DC510 coating surfactant was added at a concentration of 0.024 wt % of the total CTL mixture.

Example 2

A photoconductive element was prepared in the same manner as described in Example 1, except that the dry coverage of the barrier layer was 0.05 g/ft$^2$.

Example 3

A photoconductive element was prepared in the same manner as described in Example 1, except that the dry coverage of the barrier layer was 0.10 g/ft$^2$.

Example 4

A photoconductive element was prepared in the same manner as described in Example 1, except that a different polyester ionomer, namely, poly[1,4-cyclohexylenedimethylene-co-2,2'-oxydiethylene (23/77) isophthalate-co-5-sodiosulfo-1,3-benzenedicarboxylate (88/12), an experimental polymer obtained from Eastman Chemical Co., was used as the barrier layer at a dry coverage of 0.02 g/ft$^2$.

Example 5

A photoconductive element was prepared in the same manner as described in Example 4, except that the dry coverage of the barrier layer was 0.05 g/ft$^2$.

Example 6

A photoconductive element was prepared in the same manner as described in Example 4, except that the dry coverage of the barrier layer was 0.10 g/f$^2$.

Comparative Example 7

A photoconductive element was prepared in the same manner as described in Example 1, except that no barrier layer was coated under the CGL.

Comparative Example 8

A photoconductive element was prepared in the same manner as described in Example 1, except that cellulose nitrate was coated as a barrier layer from a 6 wt % solution in methyl ethyl ketone at a dry coverage of 0.12 g/ft$^2$.

Test Procedures

Examples 1–8 were evaluated by the following test procedures in order to ascertain the effectiveness of the barrier layer in minimizing breakdown and to determine if any of the barrier layers cause any deleterious side effects.

Sensitometry. Each sample was tested for charge-acceptance, photo decay, and dark decay. Each sample was first corona-charged to an initial voltage ($V_o$) of about −500 V. The charge was then allowed to decay in the dark for 2 sec, followed by photo decay with an exposure of about 2 erg/cm$^2$/sec for 20 sec at 680 nm. The dark decay (DD) is expressed as the rate of charge decay in V/sec for the initial 2 sec. A low DD is desirable. The photodecay (PD) is defined as the amount of exposure in erg/cm$^2$ required to discharge the film to 80% of actual $V_o$. The lower the PD, the better. The voltage remaining on the film sample after exposure is complete is known as the "toe" voltage ($V_t$). A low $V_t$, is desirable. The sensitometric data for each of the examples are set forth in the Table 1, below.

Breakdown. Three samples of photoconductive elements from each of the Examples 1–8 were corona-charged to about −500 V, then each sample was bathed for 30 sec in a liquid electroscopic developer which contains negatively charged, submicron toner particles suspended in Isopar™ G hydrocarbon liquid. Each sample was air-dried for 2 minutes at room temperature, then for 2 minutes at 60° C. Each sample was then viewed at 24× magnification, and three separate 1-mm$^2$ fields on each 2-inch by 2-inch film sample were evaluated for breakdown by counting the number of black spots in each field. Thus, each of the Examples 1–8 were measured a total of 9 times: three samples times three 1-mm$^2$ fields per sample. The total number of breakdown spots was summed over all 9 measurements and then divided by 9 to get the average number of breakdown spots/mm$^2$ for each example. The lower the number of breakdown spots, the better. The breakdown data for each of the examples are set forth in the accompanying table.

Electrical Granularity. The uniformity of the surface charge on each of the Examples 1–8 was evaluated by corona-charging a sample of each film to about −500 V and measuring the standard deviation (σ) of the actual measured voltage over a distance of about 120 mm. A lower value of σ indicates a more uniform charge acceptance, i.e., lower electrical granularity. The electrical granularity data for each of the examples are set forth in Table 1.

TABLE 1

| EXAMPLE | $V_o$ (V) | DD (V/sec) | PD (erg/cm$^2$) | $V_t$ (V) | BREAKDOWN (spots/mm$^2$) | σ (V) |
|---|---|---|---|---|---|---|
| 1 | −500 | 1 | 3.4 | −10 | 1.0 | 0.55 |
| 2 | −506 | 1 | 3.5 | −8 | 0.4 | 0.37 |
| 3 | −508 | 2 | 3.5 | −12 | 0.3 | 0.48 |
| 4 | −496 | 1 | 3.6 | −12 | 0.9 | 0.55 |
| 5 | −512 | 2 | 3.4 | −10 | 0.4 | 0.34 |
| 6 | −506 | 1 | 3.6 | −12 | 0.2 | 0.41 |
| 7 | −502 | 1 | 4.3 | −44 | 0.7 | 1.41 |
| 8 | −500 | 1 | 3.7 | −12 | 5.0 | 0.61 |

The data in the Table 1 indicate that the Examples 1–6 of the present invention, which each contain a thin polyester ionomer barrier layer, substantially reduce the occurrence of breakdown spots without sacrificing sensitometry or electrical granularity when compared to a control that does not contain a barrier layer (Example 7). Furthermore, the cellulose nitrate barrier layer (Example 8) suffers from a higher photodecay, a higher $V_r$, and a higher electrical granularity than the barrier layers of the present invention. Another series of barrier layer films was coated under similar conditions and evaluated for utility in a different manner, as follows.

Example 9

A multi-active photoconductive film comprising a conductive support, a barrier layer (BL), a charge generation layer (CGL), and a charge transport layer (CTL), coated in that order, was prepared from the following compositions and conditions.

A barrier layer solution comprising 5 wt. % poly[1,4-cyclohexylenedimethylene-co-2,2'-oxydiethylene (22/78) isophthalate-co-5-sodiosulfo-1,3-benzenedicarboxylate (89/11)] (a water-dispersible polyester ionomer obtained from Eastman Chemicals Co. as AQ®38 polymer) and 0.12 wt % Olin 10G coating surfactant in distilled water was coated at a dry coverage of 0.05 g/ft$^2$ on 7-mil nickelized poly (ethylene terephthalate) support.

Coated thereon at a dry coverage of 0.61 g/ft$^2$ was a CGL mixture comprising 490.5 wt % polycarbonate (Lexan™), 2.5 wt % poly(ethylene-co-2,2-dimethylpropylene terephthalate), 39.25 wt % 1,1-bis-[4-(di-4-tolylamino) phenyl]cyclohexane, 0.75 wt % diphenylbis-(4-diethylaminophenyl)methane (obtained from the 6.4 wt % 4-(4-dimethylaminophenyl)-2,6-diphenylthiapyrylium hexafluorophosphate, 1.6 wt % 4-(4-dimethylaminophenyl)-2-(4-ethoxyphenyl)-6-phenylthiapyrylium fluoroborate aggregating dye, and 2.4 wt % of aggregate "seed" (a dried paste of the above CGL mixture which had been previously prepared). The CGL mixture was prepared at 8.5 wt % in an 80/20 (wt/wt) mixture of a dichloromethane and 1,1,2-trichloroethane. DC510 coating surfactant was added at a concentration of 0.01 wt % of the total CGL mixture.

A third layer (CTL) was coated onto the CGL at a dry coverage of 1.2 g/ft$^2$. The CTL mixture comprised 60 wt % poly[4,4'-(2-norbornylidene)bisphenylene terephthalate-co-azelate-(60/40)], 19.75 wt % 1,1-bis-[4-(di-4-tolylamino) phenyl]cyclohexane, 19.5 wt % tri-(4-tolyl)amine, and 0.75 wt % diphenylbis-(4-diethylaminophenyl)methane. The CTL mixture was prepared at 10 wt % in a 70/30 (wt/wt) mixture of dichloromethane and methyl acetate. DC510 coating surfactant was added at a concentration of 0.024 wt % of the total CTL mixture.

Example 10

A photoconductive element was prepared in the same manner as described in Example 9, except that the barrier layer comprised 2.5 wt. % AQ®38 polymer in a solvent system of 45 wt. % dichloromethane, 45 wt. % 1,1,2-trichlorethane and 10 wt. % methanol with no coating aid.

Comparative Example 11

A photoconductive element was prepared in the same manner as described in Example 9, except that no barrier layer was coated under the CGL.

Testing Methods

Examples 9 to 11 were evaluated by the following tests in order to determine if the barrier layers affected sensitometry in a negative way as well as to determine the effect of the barrier layers on breakdown.

Sensitometry. Each sample was tested for charge-acceptance, dark decay and photodecay. Each sample was first corona-charged to approximately −500 V. It was allowed to decay in the dark for 1 second, followed by photodecay after exposure at 680 nm by a 160 microsecond xenon flash lamp. Dark decay (DD) is the rate of charge decay in V/sec. The dark film voltage is measured 8 seconds after the sample has been charged to the initial voltage, $V_o$ and maintained in the absence of light. The film is erased and then recharged to −500 V to measure the photodecay. Photodecay (PD) is defined as the exposure in ergs/cm$^2$ required to discharge the sample to 80% of $V_o$. $V_r$, known as the toe voltage, is the voltage left on the sample after exposure is complete. The lower PD and $V_1$ the better. Table 2 below lists the sensitometric data for each of Examples 9 to 11.

Breakdown. Breakdown was measured by charging a film sample (dimensions 8.5"×6.5") to a $V_o$ of −600 V on an apparatus which conveyed the charged film in the dark at a rate of 5 in./sec. to a development site biased at 100 V offset from $V_o$. The sample passed over the development station at a rate of 5 in./sec. Samples were examined at 160× magnification and breakdown spots were counted in three separate 1 mm$^2$ areas of the sample. Breakdown spots were summed and divided by 3 to get the number of breakdown spots per mm$^2$.

TABLE 2

| Example # | $V_o$ (V) | DD (V/sec) | PD (ergs/cm$^2$) | $V_t$ (V) | Breakdown (spots/mm$^2$) |
|---|---|---|---|---|---|
| 9 | −500 | 0.6 | 4.7 | 35 | 0.1 |
| 10 | −500 | 0.2 | 4.7 | 36 | 0.1 |
| 11 | −500 | 0.2 | 4.7 | 37 | 0.5 |

The data show that Examples 9 and 10 of the present invention, where each has a thin polyester ionomer barrier layer do not affect the sensitometry when compared to the control film where there is no barrier layer (Comparative Example 11). Breakdown spots were measured for the Examples. Comparative Example 11 had 0.5 spots/mm$^2$ while the barrier layer films showed superior performance for breakdown as shown in Table 2 above.

The invention has been described with particular reference to preferred embodiments thereof, but it will be understood that variations and modifications can be effected by a person of ordinary skill in the art within the spirit and scope of the invention.

We claim:

1. A photoconductive element comprising an electrically conductive support and a photoconductive material capable of generating positive charge carriers when exposed to actinic radiation, said element having, situated between said support and said photoconductive material, an electrical barrier layer that restrains the injection of positive charge carriers from the conductive support, said barrier layer comprising a polyester ionomer.

2. An element according to claim 1 which is a multiactive element and which comprises a charge generation layer in contact with said barrier layer and a p-type charge transport layer in contact with said charge generation layer.

3. An element of claim 2, wherein said polyester ionomer comprises the reaction product of:

(a) a first dicarboxylic acid;

(b) a second dicarboxylic acid, said second dicarboxylic acid comprising an aromatic nucleus and, attached to said aromatic nucleus, an ionic sulfonate group, said second dicarboxylic acid comprising from about 1 to 40 mol percent of the total moles of first and second dicarboxylic acids; and (c) an aliphatic, cycloaliphatic or aralkyl diol compound, or mixtures thereof.

4. An element of claim 3, wherein said first dicarboxylic acid is an aromatic dicarboxylic acid.

5. An element of claim 4, wherein said first dicarboxylic acid is selected from isophthalic acid, 5-t-butylisophthalic acid, terephthalic acid, 2,6-naphthalenedicarboxylic acid, 1,1,3-trimethyl-3(4-carboxyphenyl)-5-indancarboxylic acid, or mixtures thereof.

6. An element of claim 3, wherein said second dicarboxylic acid is a water-dispersible salt of 5-sulfo-1,3-benzenedicarboxylic acid.

7. An element of claim 3 wherein said diol compound is selected from ethylene glycol, propylene glycol, 1,2-propanediol, 2,2-dimethyl-1,3-propanediol, 1,2-cyclohexanedimethanol, 1,4-cyclohexanedimethanol, p-xylylenediol, 4,4'-isopropylidene-bisphenoxydiethanol, 4,4'-indanylidene-bisphenoxyldiethanol, 4,4'-fluorenylidene-bisphenoxydiethanol, glycols having the general structure $H-(OCH_2CH_2)_n-OH$, where n=2 to 10, or mixtures thereof.

8. An element of claim 3, wherein said first dicarboxylic acid is isophthalic acid and said diol compound is diethylene glycol, 1,4-cyclohexanedimethanol, or mixtures thereof.

9. An element of claim 8, wherein said second dicarboxylic acid comprises a water dispersible salt of 5-sulfo-1,3-benzenedicarboxylic acid, said second acid comprising from about 5 to 25 mol percent of the total moles of said first and second acids.

10. An element of claim 9, wherein said polyester ionomer comprises a water-dispersible salt of poly(2,2'-oxydiethylene isophthalate-co-sulfobenzenedicarboxylate).

11. An element of claim 9, wherein said polyester ionomer comprises a water-dispersible salt of poly (cyclohexylenedimethylene-co-oxydiethylene isophthalate-co-sulfobenzene-dicarboxylate).

12. An element of claim 10, wherein said polyester ionomer comprises a poly(2-2'-oxydiethylene isophthalate-co-sodiosulfobenzenedicarboxylate).

13. An element of claim 11, wherein said polyester ionomer comprises a poly(cyclohexylenedimethylene-co-oxydiethylene isophthalate-co-sodiosulfobenzenedicarboxylate).

14. An element of claim 12, wherein aid polyester ionomer comprises poly[2,2'-oxydiethylene isophthalate-co-5-sodiosulfo-1,3-benzenedicarboxylate (89/11)].

15. An element of claim 13, wherein said polyester ionomer comprises poly[1,4-cyclohexylenedimethylene-co-2,2'-oxydiethylene (46/54) isophthalate-co-5-sodiosulfo-1,3-benzenedicarboxylate (82/18)].

16. An element of claim 13, wherein said polyester ionomer comprises poly[1,4-cyclohexylenedimethylene-co-2,2'-oxydiethylene (22/78) isophthalate-co-5-sodiosulfo-1,3-benzenedicarboxylate (89/11)].

17. A method of preparing a photoconductive element having resistance to injection of positive charge carriers from its electrically conductive support which comprises coating on an electrically conductive support as a barrier layer, an aqueous dispersion of a polyester ionomer, coating a charge generation layer over said barrier layer, and coating a p-type charge transport layer over said charge generation layer.

18. A method of claim 17, wherein said photoconductive element is a multiactive element comprising a charge generation layer in contact with said barrier layer and a p-type charge transport layer in contact with said charge generation layer.

19. A method of claim 18, wherein said polyester ionomer comprises the reaction product of:

(a) a first dicarboxylic acid, said first dicarboxylic acid being an aromatic dicarboxylic acid;

(b) a second dicarboxylic acid, said dicarboxylic acid comprising an aromatic nucleus and, attached to said aromatic nucleus, an ionic sulfonate group, said second dicarboxylic acid comprising from about 1 to 40 mol percent of the total moles of first and second dicarboxylic acids; and (c) an aliphatic, cycloaliphatic or aralkyl diol compound, or mixtures thereof.

20. A method of claim 19, wherein said first dicarboxylic acid is isophthalic acid, 5-t-butylisophthalic acid, 1,1,3-trimethyl-3-(4-carboxyphenyl)-5-indancarboxylic acid, or mixtures thereof, and said second dicarboxylic acid is a water-dispersible salt of 5-sulfo-1,3-benzenedicarboxylic acid, said second acid comprising about 5 to 25 mol percent of the total moles of said first and second acids.

21. A method of claim 20, wherein said first dicarboxylic acid is isophthalic acid and said diol compound is 1,2-cyclohexanedimethanol, 1,4-cyclohexanedimethanol, 2,2-dimethyl-1,3-propanediol, glycols having the general structure $H-(OCH_2CH_2)_n-OH$, where n=2 to 10, or mixtures thereof.

22. A method of claim 21, wherein said polyester ionomer comprises a water-dispersible salt of poly(2,2'-oxydiethylene isophthalate-co-sulfobenzenedicarboxylate).

23. A method of claim 21, wherein said polyester ionomer comprises a water-dispersible salt of poly (cyclohexylenedimethylene-co-oxydiethylene isophthalate-co-sulfobenzenedicarboxylate).

24. A method of claim 22, wherein said polyester ionomer comprises poly[2,2'-oxydiethylene isophthalate-co-5-sodiosulfo-1,3-benzenedicarboxylate (89/11)].

25. A method of claim 23, werein said polyester ionomer comprises poly[1,4-cyclohexylenedimethylene-co-2,2'-oxydiethylene (46/54) isophthalate-co-5-sodiosulfo-1,3-benzenedicarboxylate (82/18)].

26. A method of claim 23, wherein said polyester ionomer comprises poly[1,4-cyclohexylenedimethylene-co-2,2'-oxydiethylene (22/78) isophthalate-co-5-sodiosulfo-1,3-benzenedicarboxylate (89/11)].

* * * * *